United States Patent [19]

Stackig

[11] 3,949,935

[45] Apr. 13, 1976

[54] PHOTOGRAPHIC PRINT ENVELOPE HAVING ADHESIVE TRANSFER TABS

[75] Inventor: Sven Goran Stackig, McLean, Va.

[73] Assignee: Photo Marketing Systems Company, Beltsville, Md.

[22] Filed: Aug. 8, 1975

[21] Appl. No.: 603,205

[52] U.S. Cl. ..... 229/68 R; 40/125 A; 40/158 R; 206/513

[51] Int. Cl.[2] ..... B65D 27/00

[58] Field of Search ..... 40/125 A, 104.18, 158 R; 229/68 R, 70; 206/460, 455, 456, 513

[56] References Cited

UNITED STATES PATENTS

| | | | |
|---|---|---|---|
| 2,188,813 | 1/1940 | King | 229/68 R |
| 2,191,704 | 2/1940 | Bennett | 40/125 A |
| 3,356,286 | 12/1967 | Greason | 229/70 |
| 3,368,741 | 2/1968 | Mercur | 229/70 |
| 3,537,637 | 11/1970 | Hiersteiner | 229/70 |

*Primary Examiner*—Stephen P. Garbe
*Attorney, Agent, or Firm*—Elliott I. Pollock

[57] ABSTRACT

An envelope for photographic prints includes a low-cohesion polished surface portion supporting a plurality of removable, adhesively-backed tabs thereon. The level of adhesion between the adhesive and backing paper portions of each tab is greater than the level of adhesion between the adhesive and the polished surface portion of the envelope but less than the level of adhesion between the adhesive and photographic print paper, whereby each tab may be removed from the polished surface portion, its adhesive layer may then be applied to the back of a photographic print, and the backing paper portion of the tab may thereafter be removed to transfer the adhesive layer from the tab to the photographic print back to permit the photographic print to be mounted in an album or the like.

4 Claims, 5 Drawing Figures

PHOTOGRAPHIC PRINT ENVELOPE HAVING ADHESIVE TRANSFER TABS

BACKGROUND OF THE INVENTION

When photographic prints are returned by a photofinishing service, it is ordinarily necessary to take special steps if it is desired to mount such prints in an album, on a wall, or the like. Various mounting structures are commercially available, e.g., special corner supports, foldable gummed labels, specially constructed album pages, etc., but these known approaches all require that a somewhat time consuming, relatively inconvenient, and sometimes comparatively expensive, procedure be followed to mount photographic prints. As a result of these known disadvantages, photographic prints are often left unmounted notwithstanding the attendant risk of possible loss of or damage to the prints as well as the comparative inconvenience of viewing such unmounted prints.

The present invention, recognizing these disadvantages, is concerned with a novel envelope which may be employed by photofinishing firms to return processed photographic prints, with the envelope including, as an integral portion thereof, adhesive transfer tabs which may be employed by the user to mount the returned prints in an album or the like The general concept of providing photographic print envelopes or postcards with tabs or adhesive strips has, in itself, been suggested heretofore, e.g. see Greason U.S. Pat. Nos. 3,356,286, Mercur 3,368,741, Von-Clemm 3,506,186, Hiersteiner 3,537,637, and Nasalski et al 3,847,325. However these prior arrangements are quite different from those contemplated by the present invention, are provided for other purposes, and are not adapted to achieve the immediate, convenient, and relatively inexpensive mounting of photographic prints which characterize the present invention.

SUMMARY OF THE INVENTION

In accordance with the present invention, a photographic envelope of generally known form, having an open-sided pocket adapted to receive a plurality of photographic prints, and having a foldable closure flap cooperating with said pocket, is modified to provide, preferably on the interior of said closure flap or at some other region of the envelope which is selectively covered by said flap, a plurality of removable, adhesively-backed tabs the adhesive layers of which may be transferred to the backs of the photographic prints to facilitate the mounting of such prints in an album of the like.

The tabs each comprise a layer of backing paper having a layer of pressure sensitive adhesive thereon, and the tabs are supported in place on the envelope with their adhesive layers in contact with a comparatively low-cohesion polished surface forming a portion of the envelope or comprising a separate sheet of material adhesively secured to the envelope. The level of adhesion between the adhesive layer and backing paper portions of each tab is greater than the level of adhesion between said adhesive layer and the polished surface portion of the envelope whereby each tab may be readily removed as a unit from the polished surface portion of the envelope. Each tab is so fabricated, moreover, that the level of adhesion between its adhesive layer and associated backing paper portion is less than the level of adhesion which is produced when the adhesive layer portion of the tab is applied to photographic print paper. As a result, when a tab is removed from the polished surface portion of the envelope, its exposed adhesive layer may then be brought into engagement with the back of a photographic print, whereafter the backing paper layer of the tab can be readily removed to leave only the adhesive layer on the photographic print back. This transferred adhesive layer can then be used to affix the print to an album page, to a wall, or to any other desired mounting surface.

BRIEF DESCRIPTION OF THE DRAWINGS

The foregoing objects, advantages, construction and operation of the present invention will become more readily apparent from the following description and accompanying drawings in which.

DESCRIPTION OF THE PREFERRED EMBODIMENTS

Figure 1:
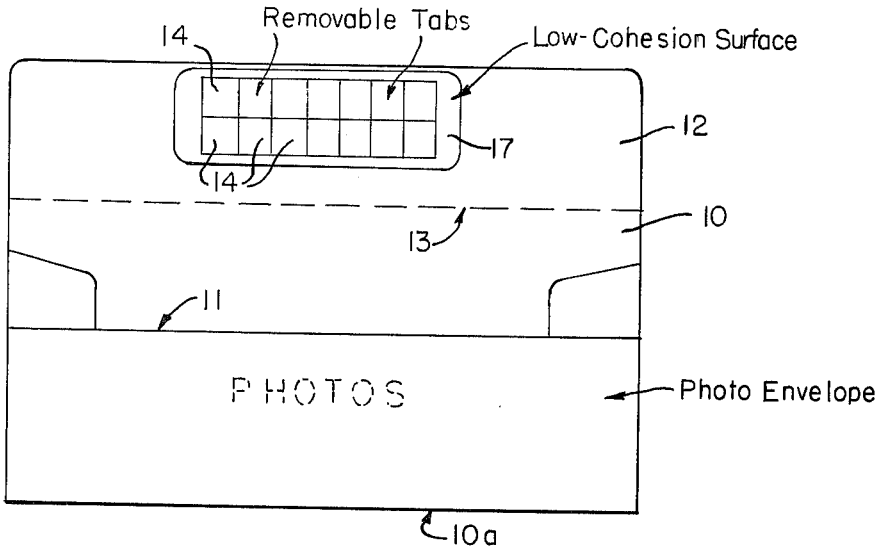
FIG. 1 is a plan view of a photographic envelope constructed in accordance with the present invention.

FIG. 1 illustrates a photographic envelope 10 of the general type with which the present invention is concerned, said envelope comprising a pocket 11 having an upper opening into which a plurality of photographic prints may be inserted following completion of a photofinishing process. The envelope 10 further includes a closure flap 12 selectively foldable about a line 13 to cover or uncover the opening to pocket 11. These portions of the envelope are all generally conventional, and it will be appreciated that variations in the envelope structure can be made, e.g., the addition of a further pocket in which negatives are returned, etc.

In accordance with the improvement of the present invention, the envelope is modified to incorporate a plurality of adhesive transfer tabs 14 which are removably supported by the envelope at a location thereon which is covered when closure flap 12 is in its closed position, and which is exposed when closure flap 12 is folded to its open position, to minimize the possibility of inadvertent removal of the tabs from the envelope while, at the same time, making the tabs readily available when the closure flap has been positioned to provide access to photographic prints in pocket 11. In the preferred form of the invention shown in FIG. 1, the tabs 14 are mounted on the interior of closure flap 12 at a position above fold line 13, i.e., on the side of said fold line opposite to pocket 11, to facilitate the removal of photographic prints from the pocket 11 without an attendant risk that a print may engage one or more of the tabs 14 as it is removed from said pocket. Alternative mounting positions achieving these same advantages, however, are possible, e.g., the tabs 14 may be mounted on the exterior of pocket 11 between the opening thereto and the lowermost edge 10*a* of envelope 10, with the dimensions of closure flap being correspondingly increased to cover the tabs at this alternative location when closure flap 12 is folded to its closed position.

Figure 2:
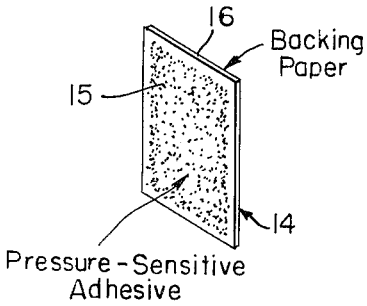
FIG. 2 is an enlarged perspective view of a typical adhesive transfer tab of the type employed in the arrangement of FIG. 1.

A typical tab 14 is shown in FIG. 2 and comprises a layer 15 of pressure sensitive, synthetic resin adhesive on a layer 16 of backing paper. A plurality of such tabs (equal to or greater in number than the number of photographic prints which are delivered in pocket 11) are disposed, as shown in FIG. 1, in side-by-side relation to one another in a multi-row rectangular array on a low cohesion surface portion 17 of the envelope. Surface portion 17 may, to minimize the cost of envelope fabrication, comprise a separate sheet of material which is fixedly secured, e.g., by adhesive, to a limited region of the interior of closure flap 12 in spaced relation to its edges.

The low-cohesion envelope portion 17 has an outer "polished" surface produced by pretreatment thereof with a low-cohesion material such as silicone or wax. By reason of these surface characteristics, the level of adhesion between surface 17 and the adhesive layer 15 of each tab 14 is less than the level of adhesion between the adhesive layer 15 and backing paper portion 16 of each tab. As a result, each tab 14 can be comparatively readily removed as a unit, with its portions 15 and 16 intact, from low-cohesion surface 17. The level of cohesion between adhesive layer 15 and backing paper layer 16 in each tab, however, is less than the level of cohesion which is produced when the adhesive layer 15 of a removed tab is subsequently applied to the back of one of the photographic prints taken from pocket 11. By reason of this latter consideration, when one of the tabs 14 is so applied to the back of a photographic print, a subsequent effort to remove the tab therefrom merely results in removal of the backing paper layer 16 leaving the adhesive layer 15 of the applied tab in place on the back of the photographic print. The resulting exposed adhesive layer on the back of the photographic print can accordingly be used to mount the print on any appropriate mounting surface.

Figure 3:
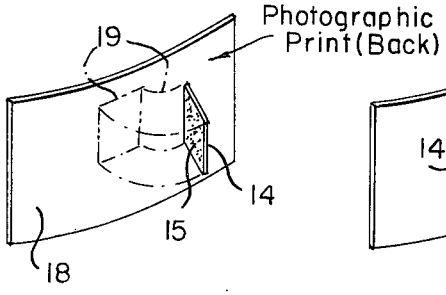
FIGS. 3, 4 and 5 depict, in sequence, how the adhesive transfer tab portions of my improved photographic envelope may be employed to facilitate the mounting of a photographic print.
Figure 4:
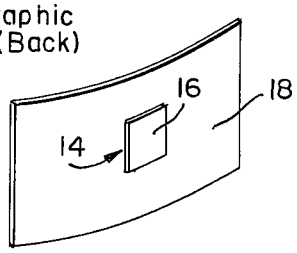
Figure 5:
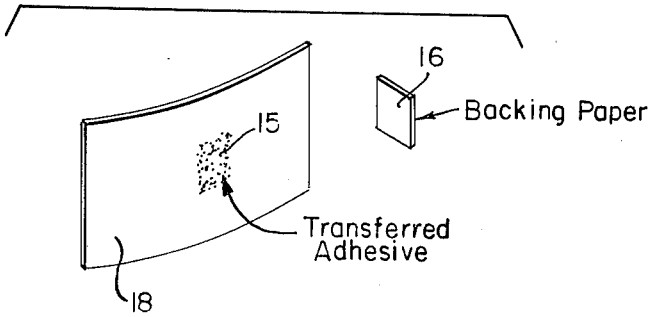

The manipulative steps discussed above, for transferring the adhesive layer from a given tab 14 to the back of a photographic print, are shown in sequence of FIGS. 3, 4 and 5. In FIG. 3, a tab 14 is depicted adjacent the back of a typical print 18, and its pressure-sensitive adhesive layer 15 may be applied at any desired location to the print back as illustrated by broken lines 19 in FIG. 3, and in full line in FIG. 4. The backing paper layer 16 may then be readily removed to leave only adhesive layer 15 on the back of print 18, as shown in FIG. 5.

While I have thus described preferred embodiments of the present invention, many variations will be apparent to those skilled in the art. It must therefore be understood that the foregoing description is intended to be illustrative only and not limitative of the present invention, and all such variations and modifications as are in accord with the principles described are meant to fall within the scope of the appended claims.

Having thus described my invention I claim:

1. A photographic envelope having an open-sided pocket adapted to receive a plurality of photographic prints, a foldable closure flap on said envelope adapted to selectively cover the opening to said pocket, said envelope including a low-cohesion polished surface portion, a plurality of removable adhesively-backed tabs supported by said polished surface portion of said envelope, each of said tabs comprising a layer of backing paper spaced from said polished surface portion by a layer of pressure sensitive adhesive, the level of adhesion between said adhesive and said backing paper being greater than the level of adhesion between said adhesive layer and said polished surface portion whereby each of said tabs and its associated layer of adhesive may be selectively removed as a unit from said surface portion, the level of adhesion between said adhesive layer and said backing paper being less than the level of adhesion between said adhesive layer and the paper in said photographic prints, whereby the adhesive layer of a removed tab may be applied to the back of a photographic print taken from said pocket and the backing paper layer of said tab may thereafter be readily removed to transfer said adhesive layer from said backing paper layer to said photographic print back, said polished surface portion and the removable tabs supported thereby being positioned on said envelope at a location which is concealed by said closure flap when said flap is folded to cover the opening to said pocket and which is exposed to permit selective removal of said tabs from said surface portion for application to the backs of the photographic prints taken from said pocket when said flap is manipulated to uncover the opening to said pocket and gain access to photographic prints in said pocket.

2. The envelope of claim 1 wherein said closure flap is foldable about a fold line spaced from said pocket, said polished surface portion and the tabs supported thereby being located on the interior of said foldable closure flap on the side of said fold line opposite to said pocket.

3. The envelope of claim 2 wherein said polished surface portion of said envelope comprises the surface of a separate sheet of material which is fixedly secured to a limited region of the interior of said closure flap in spaced relation to the edges of said closure flap.

4. The envelope of claim 3 wherein said plurality of removable tabs are disposed in side-by-side relationship to one another in a multi-row rectangular array on the polished surface portion of said separate sheet of material.

* * * * *